US005214852A

United States Patent [19]

Napolitano

[11] Patent Number: 5,214,852

[45] Date of Patent: Jun. 1, 1993

[54] FIBERGLASS INSULATION CUTTING TOOL

[76] Inventor: Joseph Napolitano, 27 Pace St., Old Bridge, N.J. 08857

[21] Appl. No.: 897,022

[22] Filed: Jun. 11, 1992

[51] Int. Cl.[5] ..... B26B 3/00

[52] U.S. Cl. ..... 30/125; 30/317

[58] Field of Search ..... 30/125, 162, 151, 329, 30/332, 337, 317, 2

[56] References Cited

U.S. PATENT DOCUMENTS

| | | | |
|---|---|---|---|
| 4,109,380 | 8/1978 | Anderson | 30/125 |
| 4,761,882 | 8/1988 | Silverstein | 30/162 |
| 4,939,839 | 7/1990 | Gorst | 30/125 |
| 4,958,427 | 9/1990 | Smith et al. | 30/125 |
| 5,012,581 | 5/1991 | Fletcher et al. | 30/162 |

*Primary Examiner*—Frank T. Yost
*Assistant Examiner*—Hwei-Siu Payer
*Attorney, Agent, or Firm*—Charles I. Brodsky

[57] ABSTRACT

A fiberglass insulation cutting tool is described as including a blade extending forwardly from the front portion of a one-piece housing having a handle grip for the user to grasp onto. The front portion of the tool is rounded at the bottom and is tapered inwardly from its sides, to compress under pressure the fiberglass insulation to be cut by the blade as the tool is dragged rearwardly in use.

5 Claims, 1 Drawing Sheet

FIBERGLASS INSULATION CUTTING TOOL

FIELD OF THE INVENTION

This invention relates to the field of construction, in general, and to a fiberglass insulation cutting tool as may be employed therein, in particular.

BACKGROUND OF THE INVENTION

As is well known and understood, the manner of installing fiberglass insulation on a construction job leaves much to be desired. By and large, the most commonly employed method uses a utility knife and a 2×4 piece of wood to compress the insulation as the worker scores it with a knife—as the two 2×4 is pushed down over and across the insulation to compress it, the installer then cuts it with the utility knife. As is also well known and understood, this is time-consuming process, and one which is not very efficient in use.

Two other methods of cutting fiberglass insulation also exist—in one, a paper cutter is utilized, in which the blade is pivoted upward to place the insulation on a flat surface, where it rests while the blade is rotated downwardly to complete the cutting action; in the other, a pair of scissors is used to perform the cutting action. As will be appreciated, not every installer carries a cutting board along with him, and the "scissor" arrangement is both quite time consuming and not very accurate in use.

And, clearly, all of these methods are far more appropriate to employ when the insulation has not yet been installed—and thus easier to deal with off-the-wall on a flat surface, it becomes much more difficult to carry out the cutting step when the fiberglass insulation is already partially installed, vertically on a wall.

OBJECTS OF THE INVENTION

It is an object of the present invention, therefore, to provide a fiberglass insulation cutting tool which is easy to use and efficient in operation.

It is another object of the invention to provide such a tool which can be used in any position, either on a flat surface or up against a framed wall.

It is a further object of the invention to provide such a fiberglass insulation cutting tool which is easy to use, accurate in operation, and one which can be manufactured and sold at a price which is attractive to sell at.

SUMMARY OF THE INVENTION

As will become clear from the description that follows, the fiberglass insulation cutting tool of the invention includes a blade extending forwardly from the front portion of a one-piece housing having a handle grip for the user to grasp onto. As will be seen, the front portion of the tool is rounded at the bottom and is tapered inwardly from its sides, to compress under pressure the fiberglass insulation to be cut by the blade as the tool is dragged rearwardly in use. As will be appreciated from the description that follows, the tapering that is employed allows the front portion of the tool to continue to compress the fiberglass insulation as the tool is drawn rearwardly, but reduces the amount of surface area that would otherwise have to be compressed if the front portion were not tapered.

In accordance with the present invention, the fiberglass insulation cutting tool will further be seen to include a compartment for storing the cutting blade when not in use, located at a rear portion of the housing. To increase the life of the tool, such cutting blade will also be seen to have reversible cutting edges at the opposite sides thereof, to effectively "double the life" of the blade. To facilitate use on the job, the fiberglass insulation cutting tool of the invention will be seen to additionally include a longitudinal finger extending forwardly from the rear portion of the housing, in serving as a belt-clip for the tool, allowing it to be carried about by the installer, simply and easily until it becomes time to use the cutting tool in the installation process.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
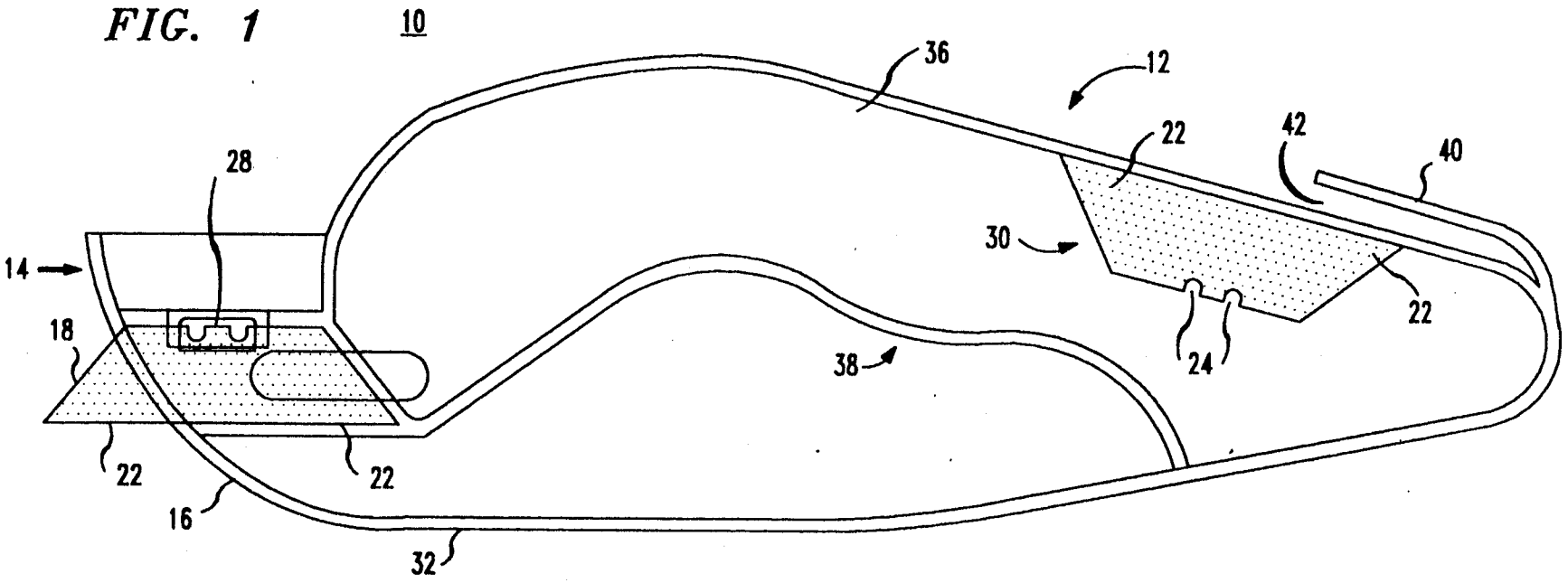
FIG. 1 is a left side sectional view of a fiberglass insulation cutting tool constructed in accordance with the teachings of the present invention.
Figure 2:
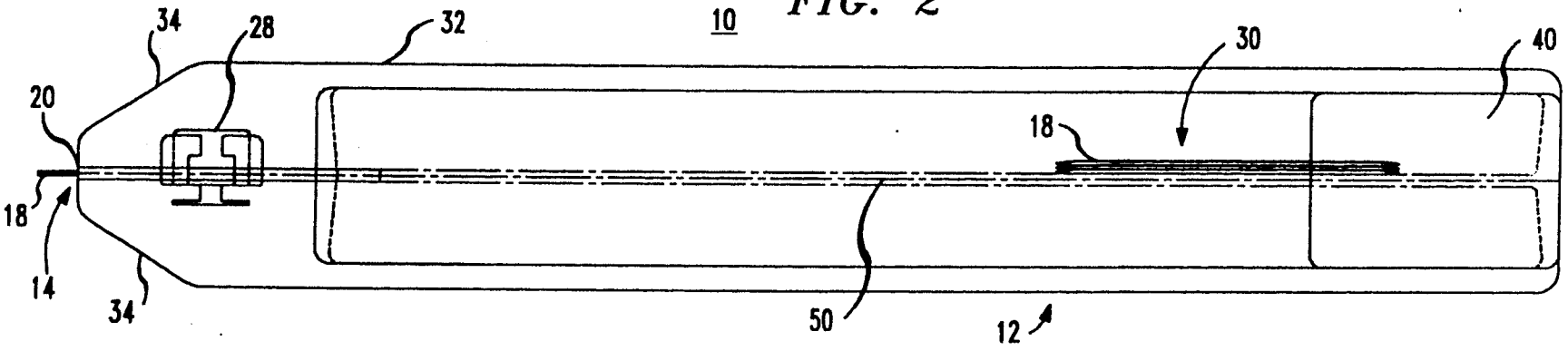
FIG. 2 is a top view of the fiberglass insulation cutting tool of the invention.

In FIGS. 1 and 2, the fiberglass insulation cutting tool 10 incorporates a one-piece housing 12, preferably of plastic composition, having a front portion which is rounded at the bottom thereof, 16. A cutting blade 18 extends forwardly from the front portion 14—extending through a slot 20 therein, having a reversible cutting edge 22 at the bottom edge of the blade 18. As will be seen, the cutting blade 18 is provided with a pair of apertures 24 to be secured in position by a blade locking clip 28. Such blade locking clip 28 is designed to slide perpendicular to the cutting blade 18, from right to left, into one of the apertures 24 on the cutting blade 18 so as to lock the blade in place. The cutting blade can be then unlocked by sliding the locking clip 28 from left to right. As will be appreciated, the blade locking clip 28 is configured with stops at either end to prevent it from sliding out from the housing 12. A compartment 30 is also included within the housing 12, located at a rear portion of the housing, for storing the cutting blade 18 when not in use, and/or for storing additional blades for later replacement. In particular, the storage compartment 30 is an indentation at the rear portion of the housing 12 in which replacement blades may be kept, including a removable cover to allow easy access to the blades. As will be readily apparent to one skilled in the art, such storage cover can be designed to slide on and off applicable guides that can be molded into the sides of the storage compartment 30 (see FIG. 2). Such "guides" will be understood to grip tabs provided on the storage cover in wrapping around the guide so as to hold the cover on, and in place, by friction.

The housing 12 also incorporates a compression plate 32 at its underside which applies the appropriate pressure to compress the fiberglass insulation as the tool 10 is dragged rearwardly in use. Such compression plate 32 will be understood as extending forwardly to meet the rounded bottom 16 of the front portion 14—which, besides being "rounded" is tapered inwardly, as shown at 34. As will be appreciated by those skilled in the art, the cooperative action of the compression plate 32, the rounded bottom 16 of the front portion 14 and the cutting edge 22 of the blade 18 all co-act in compressing the insulation as the tool 10 is dragged rearwardly, with the blade 18 then performing the cut required.

To facilitate this, the fiberglass insulation cutting tool including a hand grip 36 as part of the housing 12, for a user to grasp onto in dragging the housing rearwardly when cutting the insulation. (The underside 38 of the hand grip 36 can be molded, if desired, to receive the fingers of the hand extending around the grip 36 in dragging the tool rearwardly. To this end, it will be understood that a recess is provided between the underside 38 of the hand grip 36 and the compression plate 32, so as to allow the fingers of the user to be inserted for grasping onto the cutting tool.

As is more clearly shown in FIG. 1, a longitudinal finger 40 extends forwardly from the rear portion of the housing 12 to serve to clip the tool to the belt of the user, by means of the spacing 42 there formed. The tool can then be easily carried about, and unclipped from the belt for subsequent use, with a blade then being removed from the storage compartment and inserted into the slot 20 to be secured into position by the blade locking clip 28. The fiberglass insulation cutting tool 10 is then ready for use.

As will also be recognized by those skilled in the art, it sometimes becomes necessary to measure accurately the width of the cut of fiberglass insulation being made, rather than just to estimate it—which becomes an easy matter to do with the fiberglass insulation cutting tool of the invention as so far described. In those instances where greater accuracy is required, an outwardly telescoping arm can be attached to the housing, extending perpendicularly from the longitudinal axis 50 of the housing 12, with a guide (not shown) to slide along the edges of the insulation being cut, so as to accurately maintain constant the width of the cut being made. If desired, such a telescoping attachment—so as to accommodate a variety of widths that might be desired—can be affixed with the fiberglass insulation cutting tool 10, at any point along the housing 12 as and where desired. Such manners of installations of these telescoping arms and guides are well known and understood in the fields of circular saws and table saws where they operate in similar manner, except that with the tool of the invention, the cutting action is done as the blade is dragged rearwardly along the insulation to be cut.

As will be appreciated by fiberglass insulation installers, the tool 10 herein described is effective in compressing the insulation right at the blade where the cutting occurs. By having the front portion 14 tapered, as at 34, a reduced amount of pressure is necessary to effectuate the compression needed. With the fiberglass insulation cutting tool being made of a molded plastic, it will also be appreciated that its cost at retail could be in the range of $6.00–$8.00, and not a great deal more than that of a standard utility knife which itself sells for $4.00 and more. However, and as will be appreciated, the cutting tool of the invention will be understood to perform the cutting function correctly every time, faster, and more efficiently. With its further ability to be employed at any angle of use, and at any position, either on a flat surface or up against a 2×4, its range of usefulness will be seen to be far greater than that presently available with the prior art methods of insulation cutting employed by those active in the construction field. Actual use of the invention has been found to carry out these advantages to fiberglass insulation of thickness up to 10 inches, and more.

While there has been described what is considered to be a preferred embodiment of the present invention, it will be understood that modifications can be made by those skilled in the art without departing from the scope of the teachings herein of having a one-piece housing with a front portion through which a cutting blade extends downwardly, to both compress the insulation and cut it through a rearward dragging of the housing by a user grasping the tool. For at least such reason, therefore, resort should be had to the claims appended hereto for a true understanding of the scope of the invention.

I claim:

1. A fiberglass insulation cutting tool comprising:

a one-piece housing having front and rear portions;

a cutting blade extending forwardly from said front portion and having a downwardly extending cutting edge;

with said front portion of said housing being downwardly rounded at the bottom thereof from front-to-back;

with said housing also including a plate extending at the underside of said housing from said front portion towards said rear portion;

with said housing further including a hand grip wherein a recess is provided between said hand grip and said plate to allow the fingers of a user to be inserted for grasping onto in dragging said housing rearwardly when cutting insulation;

and with said plate and said rounded bottom of said front portion of said housing serving to compress insulation ahead of said cutting blade as said housing is dragged rearwardly in use.

2. The fiberglass insulation cutting tool of claim 1 wherein said front portion of said housing is also tapered from side-to-side.

3. The fiberglass insulation cutting tool of claim 1 wherein said cutting blade is removable, and wherein said housing also includes a compartment for storing said cutting blade when not in use.

4. The fiberglass insulation cutting tool of claim 3 wherein said compartment is located at said rear portion of said housing.

5. The fiberglass insulation cutting tool of claim 1 wherein said housing additionally includes a longitudinal finger extending forwardly from said rear portion of said housing for serving as a belt clip for said tool.

* * * * *